United States Patent [19]

Abe et al.

[11] Patent Number: 4,771,577

[45] Date of Patent: Sep. 20, 1988

[54] AUTOMATIC ELECTRODE SHAPING APPARATUS

[75] Inventors: Hirohumi Abe; Toshio Uno, both of Toyota; Toru Iwami, Kyoto, all of Japan

[73] Assignees: Toyota Jidosha Kabushiki Kaisha, Aichi; Nitto Seiko Co., Ltd., Kyoto, both of Japan

[21] Appl. No.: 876,045

[22] Filed: Jun. 19, 1986

[30] Foreign Application Priority Data

Jul. 4, 1985 [JP] Japan ..... 60-102379[U]
Jul. 4, 1985 [JP] Japan ..... 60-102380[U]

[51] Int. Cl.[4] ..... B24B 5/36

[52] U.S. Cl. ..... 51/56 R; 51/109 R; 51/217 R; 51/125

[58] Field of Search ..... 51/109 R, 125, 126, 51/56 R, 217 R, DIG. 14, 165.74, 286

*Primary Examiner*—Frederick R. Schmidt
*Assistant Examiner*—Robert Rose
*Attorney, Agent, or Firm*—Armstrong, Nikaido, Marmelstein & Kubovcik

[57] ABSTRACT

Automatic electrode shaping apparatus comprising a grinding tool adapted to come in contact with the points of electrode tips attached to the tips of arms of a welding machine for grinding said points, a judging device for judging the shaping condition of said points of the electrode tips, and a tip holding mechanism for holding the electrode tips with the grinding tool coming in contact with the electrode tips, the grinding tool and the judging device being movable with respect to the electrode tips and alternatively located in the position opposite to the electrode tips.

According to the automatic electrode shaping apparatus, the electrode tips are held by the tip holding mechanism, and ground and shaped with the grinding tool in a stable manner. After the electrode tips have been shaped, the shaping condition of the electrode tips can be judged whether it is good or bad, without moving the electrode tips.

6 Claims, 4 Drawing Sheets

AUTOMATIC ELECTRODE SHAPING APPARATUS

BACKGROUND OF THE INVENTION

1. Field of the Invention

The present invention relates to automatic electrode shaping apparatus for shaping electrode tips attached to the tips of arms of a welding machine, with a grinding tool.

2. Prior Art

In a conventional automatic electrode shaping apparatus, electrode tips attached to the tips of arms of a welding machine (hereinafter referred to as the arms) have been shaped with a grinding tool under rotation which comes in contact with the electrode tips. However, when the electrode tips are attached as fitted to the shanks of the arm tips, the electrode tips are vibrated during grinding so that the machining condition during grinding (hereinafter referred to as the grinding condition) easily becomes unstable, or the electrode tips become idle with respect to the shanks. This disadvantageously leads to insufficient grinding or decrease in grinding accuracy.

After the completion of grinding and shaping of electrode tips once used for welding, the machining accuracy of the point diameters of the electrode tips have been conventionally checked visually by the operator or mechanically with slide calipers or the like. In this connection, there has been conventionally disposed, adjacent automatic electrode shaping apparatus, a judging device for judging whether the shaping condition of the electrode tips is good or bad, and all electrode tips after shaped have been moved for inspection, one by one, to the position opposite to this judging device. However, since the electrode tips are attached to the tips of the arms of a welding machine, it is required to move the electrode tips after shaped, to the judging device by the rotation of the arms. It has been therefore difficult to accurately locate the electrode tips in a predetermined position with respect to the judging device. There has often occurred errors in positional relation between the judging device and the electrode tips due to the poor operating ability or accuracy of a robot which rotates the arms. There have been instances where an erroneous judgement is made; for example, an electrode tip having a point diameter greatly deviated from the reference value is judged good, or a good electrode tip is judged defective. The distances between each electrode tip and a workpiece at a time of welding are numerically controlled based on the reference value above-mentioned. Accordingly, if the erroneous judgment as above-mentioned has been made, the distances between a workpiece and shaped electrode tips to be used for spot welding cannot be accurately set. The proper welding quality can therefore not be assured.

SUMMARY OF THE INVENTION

It is an object of the present invention to provide automatic electrode shaping apparatus capable of securely preventing electrode tips from being vibrated or becoming idle during grinding, so that the electrode tips can be accurately shaped.

It is another object of the present invention to provide automatic electrode shaping apparatus capable of accurately judging whether the shaping condition of electrode tips is good or bad, without moving the electrode tips after shaped.

In order to achieve these objects, the present invention provides automatic electrode shaping apparatus for shaping electrode tips attached to the tips of arms of a welding machine, which comprises a grinding tool adapted to come in contact with the points of the electrode tips for grinding these points, a judging device for judging whether the shaping condition of the points of the electrode tips is good or bad, and a tip holding mechanism for holding the electrode tips with the grinding tool coming in contact with the electrode tips, the grinding tool and the judging device being disposed movably with respect to the electrode tips and alternatively located in the position opposite to the points of the electrode tips.

In order to alternatively locate the judging device and the grinding tool in the position opposite to the points of the electrode tips, the judging device and the grinding tool may be respectively mounted on different displacing mechanisms, or both the judging device and the grinding tool may be mounted on a mounting stand which is so constructed as to be displaced. As to the displacement of the grinding tool and the judging device, the grinding tool and the judging device may be rotated or moved in a straight line.

According to the automatic electrode shaping apparatus of the present invention, electrode tips under grinding are held by the tip holding mechanism to prevent the electrode tips from being vibrated or becoming idle. The electrode tips can therefore be ground in a stable manner, thereby to improve the machining accuracy. After the electrode tips have been shaped, without the movement of the electrode tips the judging device is moved to the position opposite to the points of the electrode tips and judges whether the shaping condition of the electrode tips is good or bad. The accurate judgment can therefore be made.

DETAILED DESCRIPTION OF THE INVENTION

Figure 1:
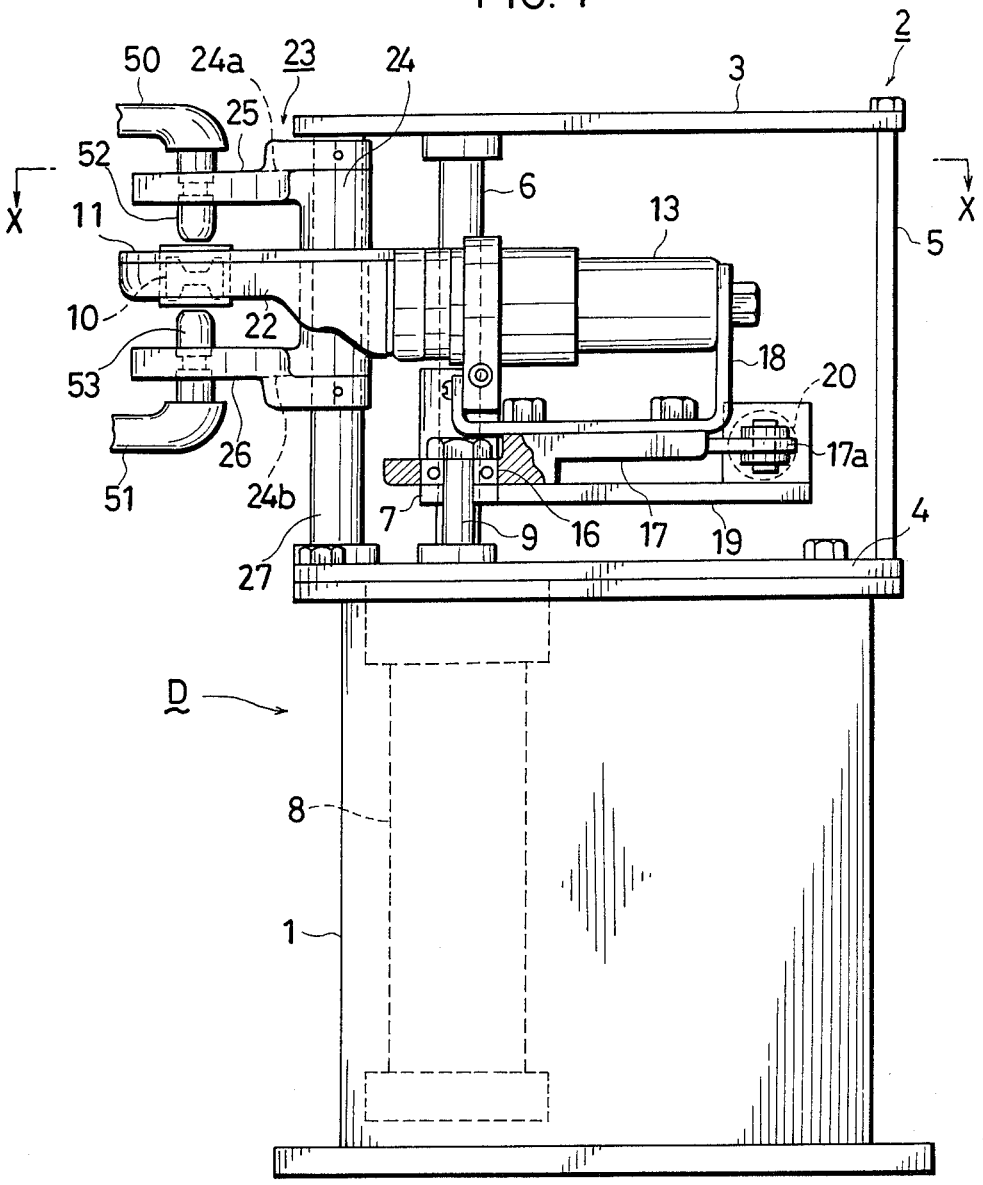
FIG. 1 is a side view of automatic electrode shaping machine in accordance with one embodiment of the present invention.

The following description will discuss a preferred embodiment of the present invention with reference to the attached drawings.

In the automatic electrode shaping apparatus illustrated in the drawings, a judging device is mounted on a mounting stand on which a grinding tool is mounted, and this mounting stand is rotatable around one point so that the judging device and the grinding tool can be alternatively located in the position opposite to electrode tips.

Figure 2:
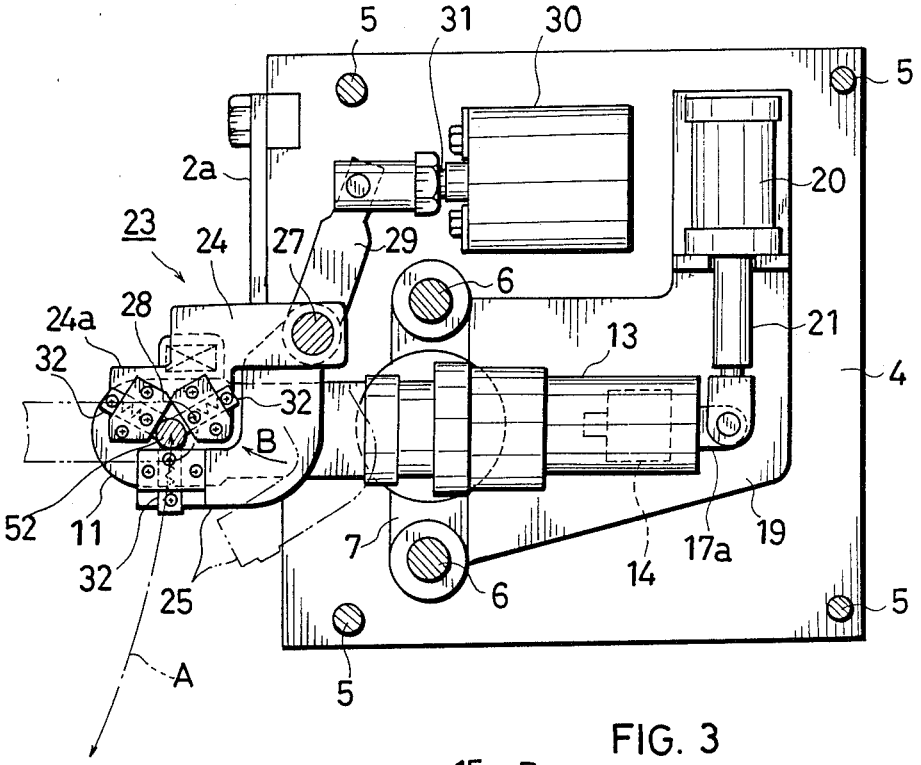
FIG. 2 is a section view taken along the line X—X in FIG. 1.

In FIG. 1, the main body D of the automatic electrode shaping apparatus in accordance with the present invention, has a frame base 1 and a frame 2 on the frame base 1. The frame 2 includes a pair of upper and lower plates 3 and 4 and a plurality of support posts 5 assembled with the plates 3 and 4. As shown in FIG. 2, the frame 2 has a pair of guide rods 6. A metal fitting 7 to be lifted and lowered as guided by these guide rods 6 is secured to a piston rod 9 of a cylinder 8 vertically installed on the frame base 1.

Figure 3:
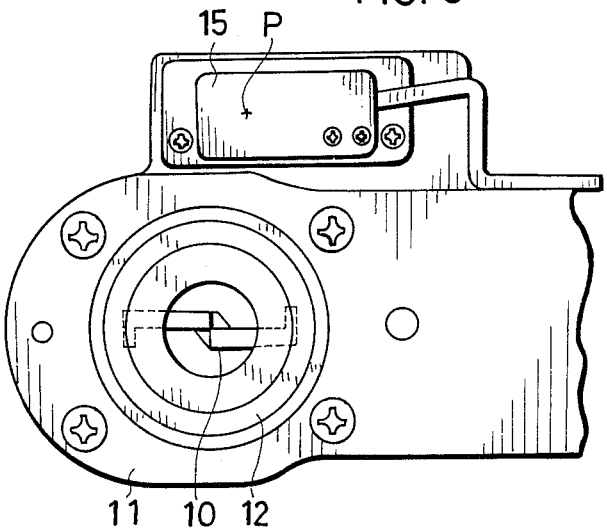
FIG. 3 is an enlarged plan view of main portions of a mounting stand on which a grinding tool and a judging device are mounted.

A grinding tool 10 has grinding surfaces of the same shape as that of the points of electrode tips 52, 53 to be ground. The grinding tool 10 is mounted on a mounting stand 11 projecting forward of the frame 2, and is held by a cylindrical holding member 12 as shown in FIG. 3. The grinding tool 10 is rotatable around a vertical axis by a rotary device source 14 such as an air motor incorporated in a case 13 integrally attached to the mounting stand 11 at it rear portion.

A mounting plate 17 is rotatably attached to the piston rod 9 of the cylinder 8 through a bearing 16. The case 13 is secured to this mounting plate 17 through a mounting member 18. Accordingly, when the cylinder 8 is operated to lift or lower the piston rod 9, the mounting stand 11 is lifted or lowered in a predetermined range together with the case 13. Because the metal fitting 7 is guided by the guide rods 6, such ascent and descent of the mounting stand 11 can be made accurately, so that the grinding tool 10 mounted on the mounting stand 11 can be securely lifted and lowered in a predetermined passage without side movement. The cylinder 8 is retractable in two stages. When the cylinder 8 is located in the neutral position as shown in FIG. 1, the electrode tips 52, 53 attached to the tips of a pair of arms 50, 51 of a welding machine (not shown) are allowed to be brought to the both upper and lower sides of the grinding machine 10 by the rotation of the arms 50 and 51.

A plate member 19 is extended to the metal fitting 7. The mounting plate 17 is connected at its rear end 17*a* to a piston rod 21 of a cylinder 20 installed on the plate member 19. This cylinder 20 constitutes a mounting stand moving mechanism. When the piston rod 21 is moved forward and backward to swing the mounting plate 17, the case 13 secured to the mounting plate 17 through the mounting member 18 and the mounting stand 11 projecting forward from the case 13 are horizontally swung with the piston rod 9 of the elevating cylinder 8 serving as the center. The grinding tool 10 is covered with a cover 22.

A tip holding mechanism 23 for holding the upper and lower electrode tips 52, 53 at the position opposite to the grinding tool 10 includes a stationary claw member 24 having a U-shape section, an upper movable claw member 25 at the upper portion of the stationary claw member 24 and a lower movable claw member 26 at the lower portion of the stationary claw member 24. As shown in FIG. 2, the stationary claw member 24 is supported by a support rod 27 rotatably mounted on the frame 2, in such manner as to permit the support rod 27 to rotate. The stationary claw member 24 is secured to a support plate 2*a* mounted on the frame 2. An upper projecting piece 24*a* of the stationary claw member 24 has a tip receiving portion 28 concaved in a V-shape. A lower projecting piece 24*b* (FIG. 1) of the stationary claw member 24 has also a tip receiving portion (not shown) similar to the tip receiving portion 28. The upper movable claw member 25 is secured to the support rod 27 so as to face the upper projecting piece 24*a* of the stationary claw member 24. A projecting rod 29 extended to the base end of the upper movable claw member 25 is connected to a piston rod 31 of a movable claw driving cylinder 30 on the frame 2. When the piston rod 31 of the cylinder 30 is pushed out to set the upper movable claw member 25 to a retreated position as shown by an imaginary line in FIG. 2, the electrode tip 52 is allowed to be brought to the position opposite to the grinding tool 10 by the rotation of the arm 50. The lower movable claw member 26 is secured to the support rod 27 so to face the lower projecting piece 24*b* of the stationary claw member 24, and is connected to the cylinder 30 as in the upper movable claw member 25.

Figure 4:
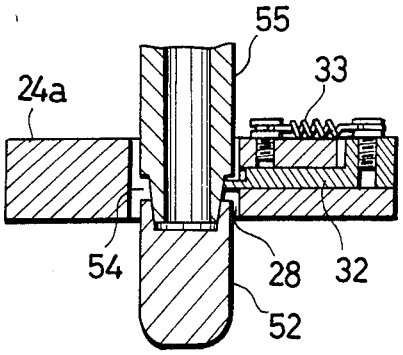
FIG. 4 is a section view illustrating a retractable piece attached to a stationary claw member.

As shown in FIG. 2, the upper projecting piece 24*a* of the stationary claw member 24 has two retractable pieces 32 at two different positions, while the upper movable claw member 25 has one retractable piece 32. As shown in FIG. 4, the retractable pieces 32 of the upper projecting piece 24*a* are normally biased in a direction toward the tip receiving portion 28 by springs 33 disposed in the upper projecting piece 24*a*. That is, these retractable pieces 32 are normally biased resiliently in a direction toward a concave 54 formed at the mounting portion of the arm 50 to which the upper electrode tip 52 is attached. This concave 54 is formed when the electrode tip 52 is fitted to a shank 55 at the tip of the arm 50.

Although the description has been made of the retractable pieces 32 of the upper projecting piece 24*a*, the retractable piece 32 of the upper movable claw member 25 is also arranged in the same manner. Accordingly, when the tip holding mechanism 23 holds the upper electrode tip 52, these three retractable pieces 32 are pushed in the concave 54 at three positions at regular angular intervals. Likewise, the lower projecting piece 24*b* of the stationary claw member 24 has two retractable pieces 32 at two different portions, while the lower movable claw member 26 has one retractable piece 32. When the lower electrode tip 53 is held, these three retractable pieces 32 are pushed in the concave 54 at three positions at regular angular intervals.

Figure 6:
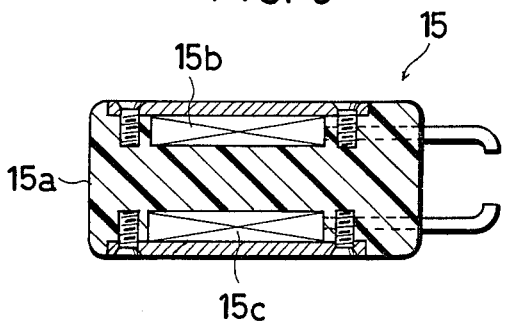
FIG. 6 is a schematic section view of the judging device.
Figure 7:
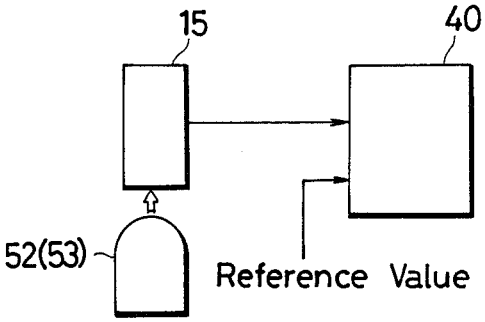
FIG. 7 is a block diagram illustrating the judging principle.
Figure 8:
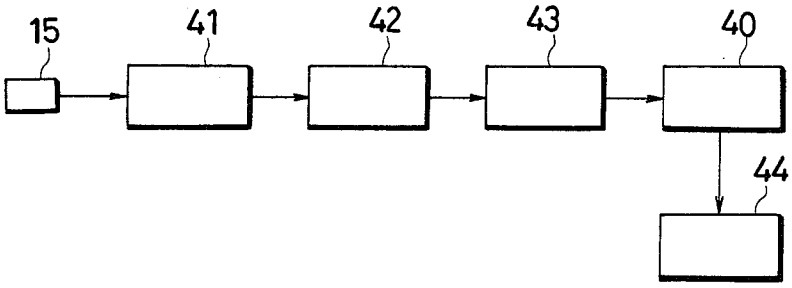
FIG. 8 is a block diagram illustrating one example of how the judgment result is displayed.

As shown in FIG. 3, a judging device 15 for judging the shaping condition of the electrode tips is disposed by the side of the grinding tool 10 on the mounting stand 11. This judging device 15 is disposed on the same plane as the plane on which the grinding tool 10 is mounted. This judging device 15 is adapted to judge whether the shaping condition of each electrode tip is good or bad, based on the point diameter of the electrode tip. As shown in FIG. 6, self-excited oscillators 15*b* and 15*c* including coils and capacitors are held on the upper and lower sides of a holding member 15*a*. Each of the oscillators 15*b* and 15*c* is adapted to supply a signal of frequency corresponding to variations of the distance between an electrode tip and each oscillators 15*b* or 15*c*, and to supply a signal of frequency corresponding to the size of the point diameter of the electrode tip when the oscillator 15*b* and 15*c* faces as separated from the electrode tip by a predetermined distance. As shown in FIG. 7, a detector signal from the judging device 15 (the self-excited oscillator 15*b* or 15*c*) is entered in a comparator 40, in which such signal is compared with the reference value corresponding to the reference value corresponding to the reference point diameter of electrode tip, so that the shaping condition of the electrode tip is judged whether it is good or bad. At this time, the detector signal from the judging device 15 is first sent to an FM detector 42 through an amplifier 41, and the signal from the FM detector 42 is sent to the comparator 40 through a DC amplifier 43, as shown in FIG. 8. The comparison result obtained in the comparator 40 is displayed on a display device 44.

The judging device 15 is not limited to that described above. As far as the shaping condition of electrode tips can be judged whether it is good or bad, any judging device can be used. For example, an image sensor can be used to optically judge the shaping condition of electrode tips.

The following description will discuss the operation of the automatic electrode shaping apparatus constructed as above-mentioned. In a short time during the electrode tips 52 and 53 are not used for spot welding, the upper and lower electrode tips 52 and 53 are brought to the position opposite to the grinding tool 10 by the rotation of the arms 50 and 51, and then shaped and checked for their shaping condition. Afterwards, the electrode tips 52 and 53 are carried out from the position opposite to the grinding tool 10 again by the rotation of the arms 50 and 51, and are used for welding.

The following description will discuss how the upper electrode tip 52 is shaped and checked.

When the electrode tip 52 is to be carried in and out by the rotation of the arm 50, the upper movable claw member 25 and the lower movable claw member 26 are moved by the cylinder 30 to the retreated position shown by the imaginary line in FIG. 2, so that a carrying passage A is opened. In such state, when the upper electrode tip 52 is brought to the position opposite to the grinding tool 10 and received by the tip receiving portion 28 of the upper projecting piece **24*a* while pushing away the retractable pieces 32 of the upper projecting piece 24*a* against the spring load of the springs 33, the retractable pieces 32 are pushed, by the spring load of the springs 33, in the concave 54 between the electrode tip 52 and the shank 55 as shown in FIG. 4. The upper movable claw member 25 is rotatingly moved in a direction toward the stationary claw member 24 by the cylinder 30 as shown by an arrow B in FIG. 2, and is moved up to a position where the upper movable claw member 25 presses the upper electrode tip 52. The upper electrode tip 52 is positioned with respect to the grinding tool 10 by a teaching machine (not shown), but the reliability of positioning the upper electrode tip 52 can be further enhanced by the arrangement above-mentioned that the upper electrode tip 52 is received by the tip receiving portion 28 concaved in a V-shape which is formed at the upper projecting piece 24*a* of the stationary claw member 24, and the upper electrode tip 52 is pressed against the tip receiving portion 28 by the upper movable claw member 25**.

Figure 5:
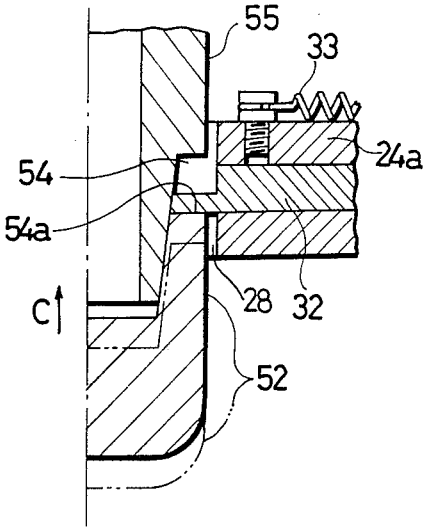
FIG. 5 is a partially enlarged section view illustrating how the retractable piece is operated.

When the upper electrode tip 52 is thus held by the tip holding mechanism 23, the mounting stand 11 set to the neutral position (which is shown in FIG. 1) by the cylinder 8 is pushed up so that the grinding tool 10 is fitted to and comes in contact with the upper electrode tip 52. The upper electrode tip 52 is ground and shaped by the grinding tool 10 rotatingly operated by the rotary drive souce 14. During grinding, the upper electrode tip 52 is held by the tip holding mechanism 23. The electrode tip 52 is therefore prevented from being vibrated or becoming idle with respect to the shank 55, thus assuring a stable grinding. If the pushing force of the cylinder 8 is applied to the electrode tip 52 during the tip 52 is shaped, it may well be that the electrode tip 52 is slided as held by the tip holding mechanism 23 and escapes upward as shown by an arrow C in FIG. 5. In such case, the pressing force of the grinding tool 10 to the electrode tip 52 becomes insufficient and a sufficient cutting during grinding cannot be assured, so that the grinding condition becomes unstable. In the present invention, however, even if the electrode tip 52 tends to escape upward as shown by the arrow C, the retractable pieces 32 engage with the upper end of the electrode tip 52 or a step portion **54*a* of the concave 54 to prevent the electrode tip 52 from being displaced. Thus, the electrode tip 52** does not further escape to assure a stable grinding.

When the shaping of the upper electrode tip 52 is completed, the cylinder 8 is reset to the neutral position and the mounting stand 11 together with the mounting plate 17 is rotated counterclockwise in FIG. 2 by the cylinder 20. The detection center P of the judging device 15 in FIG. 3 is moved up to the position opposite to the point of the upper electrode tip 52. In such position, the cylinder 8 is pushed out to cause the judging device 15 to face the upper electrode tip 52. As mentioned earlier, a signal of frequency corresponding to the point diameter of the electrode tip is supplied from the judging device 15 and then entered into the comparator 40. In the comparator 40, such signal is compared with the reference value corresponding to the reference point diameter of the upper electrode tip 52. Thus, the shaping condition is judged whether it is good or bad.

When the checking of the shaping condition of the upper electrode tip 52 is completed, the mounting stand 11 is lowered by the cylinder 8 and the mounting stand 11 is rotatably reset by the cylinder 20. The upper movable claw member 52 is retreated by the cylinder 30. The upper electrode tip 52 is then carried out by the rotation of the arm 50.

When the lower electrode tip 53 is to be continuously shaped after the upper electrode tip 52 has been shaped, the following operations can be made by way of example. After the upper electrode tip 52 has been shaped, the mounting stand 11 is lowered so that the grinding tool 10 comes in contact with the lower electrode tip 53 held by the lower projecting piece **24*b* of the stationary claw member 24 and the lower movable claw member 26. The lower electrode tip 53 is then shaped with the grinding tool 10. Thereafter, the shaping condition of the upper electrode tip 52 is judged as mentioned earlier, and then the judging device 15 is lowered to judge the shaping condition of the lower electrode tip 53. Other operations can be made in the same manner as in the upper electrode tip 52**.

Generally, the both arms 50 and 51 are rotated at the same time, and the upper and lower electrode tips 52 and 53 are continuously shaped one after another as mentioned above. However, the both arms 50 and 51 can be rotated independently or at the same time, and the upper and lower electrode tips 52 and 53 can be individually shaped and checked.

In the embodiment above-mentioned, the mounting stand 11 is rotatable around a vertical axis. However, the mounting stand 11 can be disposed in a manner slidable in a straight line in a transverse or longitudinal direction. The judging device 15 and the grinding tool 10 can be respectively mounted on different displacing (moving) mechanisms, and these mechanisms can be alternatively located in the position opposite to the electrode tips, as mentioned in the Summary of the Invention.

In order to accurately position the grinding tool 10 and the judging device 15 by the operation of the mounting stand moving mechanism constituted by the cylinder 20, it is preferred to dispose means for numerically controlling the advancing position and the retreating position of the cylinder 20 and/or a stopper for mechanically restricting the limit positions of advancement and retreat of the cylinder 20, such means and/or stopper being installed on the plate member 19.

As apparent from the foregoing, according to the automatic electrode shaping apparatus of the present invention, electrode tips attached to the tips of the arms can be held by a tip holding mechanism, thereby to prevent the electrode tips from being vibrated during grinding, even if the electrode tips are put in a condition susceptible to vibration due to the rotation of the grinding tool which comes in contact with the electrode tips. In particular, according to the present invention, the electrode tips are held directly by the tip holding mechanism. Therefore, the vibration inhibitive effect is advantageously increased as compared with apparatus in which the arms are held. Even if electrode tips are attached as fitted to shanks at the tips of the arms, it can be prevented that the electrode tips become idle during grinding. The grinding condition can therefore be stabilized to provide desired shapes as well as improved accuracy. Further, the shaping condition of electrode tips can be judged by moving the judging device to the position opposite to the electrode tips while the electrode tips are fixed to the shaping position. Regardless of the operating ability and accuracy of a robot holding a welding machine, accurate judgment can therefore be made, thus greatly contributing to improvements in welding quality.

What is claimed is:

1. An automatic electrode shaping apparatus for shaping a pair of electrode tips held by a pair of arms of a welding machine, said arms being movable to transfer said electrode tip between a welding position of said welding machine and a shaping position of said automatic electrode shaping apparatus where said electrode tips are to be shaped, said apparatus comprising:

a grinding tool mounted on a mounting stand provided on said apparatus, said grinding tool being movable to and from said electrode tips positioned at the shaping position;

a judging device attached to said mounting stand for judging the shaping condition of said electrode tips; and a pair of tip holding means for holding said electrode tips held by said arms, said tip holding means includes a stationary claw member and a movable claw member, said stationary claw member being positioned at said shaping position and said movable claw member being movable to and away from said stationary claw member.

2. Automatic electrode shaping apparatus as set forth in claim 1, wherein said stationary claw member having a tip receiving portion for receiving said pair of electrode tips brought to the position facing to and adjacent to said grinding tool by the movement of said arms of said welding machine, said movable claw member being movable between a position where electrdoe tips received by said tip receiving portion are pressed against said tip receiving portion and a retreated position for allowing said electrode tips to be brought to the position opposite to the grinding tool by the movement of the arms of a welding machine.

3. Automatic electrode shaping apparatus as set forth in claim 1 or 2, wherein the tip holding means has retractable pieces which are adapted to be normally resiliently urged in a direction toward concaves formed in said mounting portions of said arms of said welding machine and which pieces are adapted to engage with step portions of said concaves to prevent the electrode tips from being displaced when the electrode tips tend to be displaced by the upward or downward pressing force of the grinding tool.

4. Automatic electrode shaping apparatus as set forth in claim 1, wherein said judging device is mounted on a mounting stand on which the grinding tool is mounted and said mounting stand is movable by a mounting stand moving mechanism such that the grinding tool faces the electrode tips or the judging device faces the electrode tips.

5. Automatic electrode shaping apparatus as set forth in claim 4, wherein the mounting stand is rotatable around a vertical axis and the judging device is attached at a side of the grinding tool mounted on the mounting stand in a manner such that said judging device and grinding tool have a same vertical height along the axis.

6. Automatic electrode shaping apparatus as set forth in claim 1, 4 or 5, wherein the judging device has oscillators, each of which supplies a signal having a frequency corresponding to variations of the distance between said oscillator and said electrode tip and each supplies a signal having a frequency corresponding to the size of the point diameter of said electrode tip while said oscillator faces one of the electrode tips with a predetermined distance therebetween.

* * * * *